US006402143B1

(12) United States Patent
Brindley

(10) Patent No.: US 6,402,143 B1
(45) Date of Patent: Jun. 11, 2002

(54) APPARATUS AND METHOD FOR PLAYING A GAME

(76) Inventor: Warwick John Brindley, 2 Lilac Court, Congleton, Cheshire CW12 3DW (GB)

( * ) Notice: Subject to any disclaimer, the term of this patent is extended or adjusted under 35 U.S.C. 154(b) by 0 days.

(21) Appl. No.: 09/498,718

(22) Filed: Feb. 7, 2000

(51) Int. Cl.[7] ..... A63F 3/00

(52) U.S. Cl. ..... 273/236; 273/143 A; 273/242; 273/243; 273/244.2; 273/256; 273/284; 273/287

(58) Field of Search ..... 273/236, 143 A, 273/268, 242, 243, 244.2, 256, 284, 287

(56) References Cited

U.S. PATENT DOCUMENTS

| | | | | | |
|---|---|---|---|---|---|
| D58,093 | S | * | 6/1921 | Jenkins | 273/134 |
| 1,692,402 | A | * | 11/1928 | Barthel | 273/256 |
| 2,178,193 | A | * | 10/1939 | Wade | 273/143 |
| 3,433,484 | A | * | 3/1969 | Wallenmeyer | 273/134 |
| 3,901,513 | A | * | 8/1975 | Spohn | 273/135 R |
| 4,012,046 | A | * | 3/1977 | Liket | 273/134 C |
| 4,027,882 | A | * | 6/1977 | Rosenberg | 273/134 AT |
| 4,032,154 | A | * | 6/1977 | Magiera | 273/134 AT |
| 4,049,275 | A | * | 9/1977 | Skelton | 273/134 AE |
| 4,062,544 | A | * | 12/1977 | Hankins | 273/134 AF |
| 4,136,881 | A | * | 1/1979 | Anspach | 273/256 |
| 4,456,260 | A | * | 6/1984 | Hilton | 273/256 |
| 4,923,198 | A | * | 5/1990 | Diaz | 273/240 |
| 4,936,588 | A | * | 6/1990 | Radar et al. | 273/243 |
| 4,940,235 | A | * | 7/1990 | Martin | 273/236 |
| 5,121,928 | A | * | 6/1992 | Salerno-Sonneberg | 273/243 |
| 5,129,649 | A | * | 7/1992 | Scholz | 273/236 |
| 5,183,257 | A | * | 2/1993 | Shore | 273/243 |
| 5,244,391 | A | * | 9/1993 | Bryant | 434/129 |
| 5,261,666 | A | * | 11/1993 | Chen et al. | 273/146 |
| 5,342,058 | A | * | 8/1994 | Giovannetti | 273/243 |
| 5,405,150 | A | * | 4/1995 | Loder | 273/430 |
| 5,683,088 | A | * | 11/1997 | Rose | 273/243 |
| 5,749,580 | A | * | 5/1998 | Lopez | 273/243 |
| 5,906,371 | A | * | 5/1999 | Peterson | 273/249 |
| 5,938,197 | A | * | 8/1999 | Bowling | 273/143 A |

OTHER PUBLICATIONS

The Rules of Monopoly—Internet–www.games.com—pp. 1–6.*

* cited by examiner

*Primary Examiner*—Paul T. Sewell
*Assistant Examiner*—Dolores R. Collins
(74) *Attorney, Agent, or Firm*—Martin A. Hay

(57) ABSTRACT

A board game apparatus for a game that requires exercise of both judgement and ability to solve problems, simulates a capitalist system and provides players with opportunity to trade off potential reward against risk according to their ability to solve problems. The apparatus includes a board marked with a series of spaces in a loop, including an event space and territory spaces, player pieces, tokens and property pieces for placing on territory spaces. An event affecting the standing of one or more players arises when a player piece lands on an event space. When a player piece lands on a territory space, the outcome depends upon the ability of a player to solve a problem and the player's judgement on whether to trade off potential reward against risk according to their perceived ability to solve the problem. When a player is defeated, that player may join the side of the victorious player, and assist in solving problems.

12 Claims, 1 Drawing Sheet

APPARATUS AND METHOD FOR PLAYING A GAME

Figure 1:
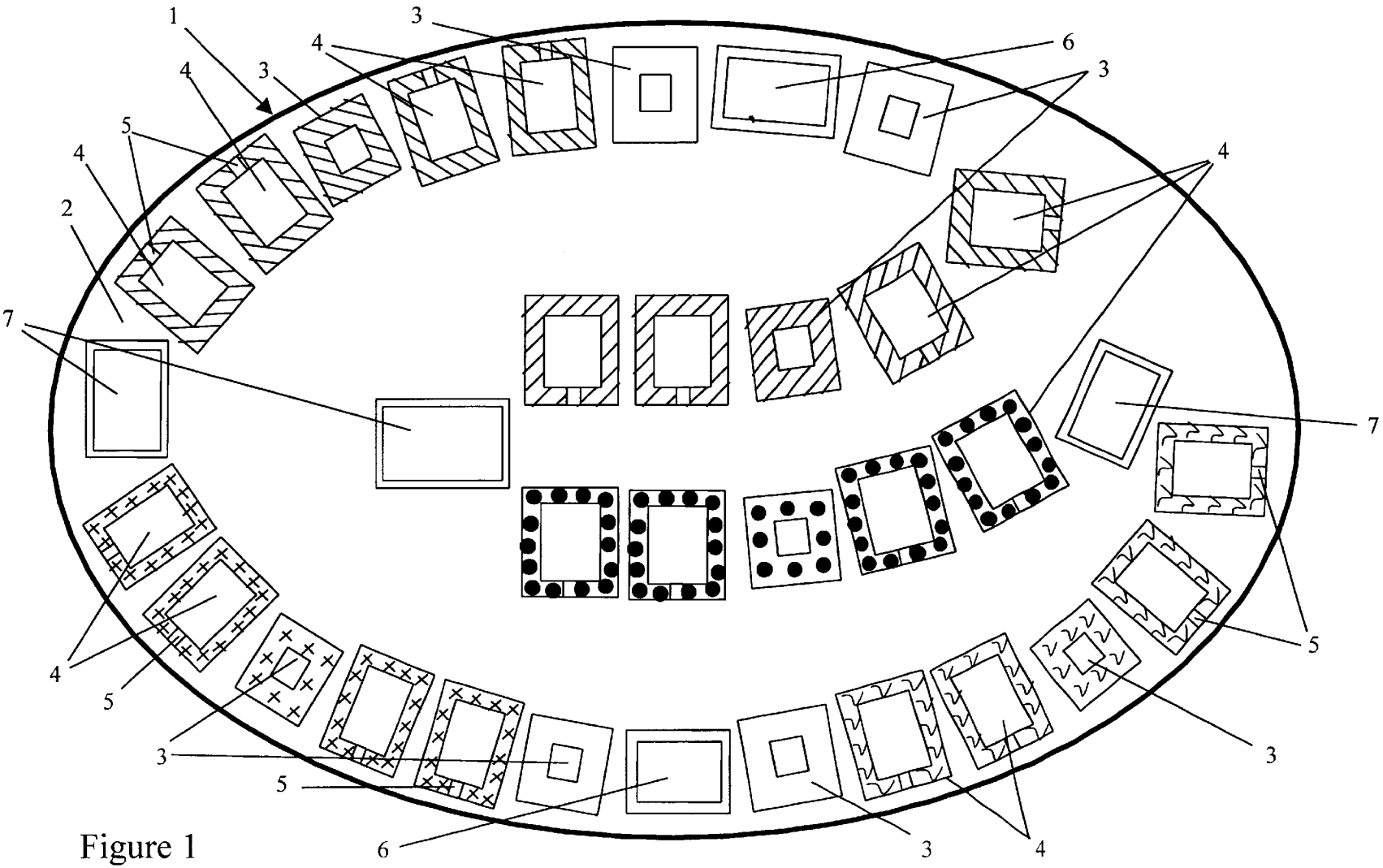

The present invention relates to an apparatus for playing a game. More particularly it relates to apparatuses for playing a board game, a computer game or a combination playing a game using the apparatuses.

BACKGROUND OF THE INVENTION

Many apparatuses for playing board games are known which comprise a board marked with a series of spaces; player pieces for moving from one space to another; and means for determining which space a player piece is to be moved to, such as a die.

Some of the known board games require players to take decisions between alternatives inherent in the rules of the game. These alternatives may have different risks and potential rewards associated with them. Thus the decisions taken by the players involve the exercise of judgement. Forms of this kind of game that are particularly popular simulate a capitalist system by involving the use of tokens representing money and asset pieces representing property, the players competing to acquire these from one another. A disadvantage of this kind of game is that some players may be forced to leave the game before it has been completed.

Others of the known board games require players to solve problems, for example to answer questions designed to test their knowledge, or to demonstrate ability to perform a task. Because the abilities of players to solve problems differ according to their particular sets of knowledge and skills, the risk associated with solving a given problem will differ between players.

A game has now been devised which requires exercise of both judgement and ability to solve problems, simulates a capitalist system and provides players with opportunity to trade off potential reward against risk according to their ability to solve problems.

SUMMARY OF THE INVENTION

The present invention provides a board game apparatus, which comprises:

- a board marked with a series of spaces arranged in a loop, said spaces comprising an event space and territory spaces;
- player pieces for moving from one space to another space in the loop;
- means for determining which space a player piece is to be moved to;
- means for determining an event affecting the standing of one or more players when a player piece lands on an event space; and
- means for determining outcomes when player pieces land on territory spaces, said means comprising
- means for determining a class of a territory space;
- means for marking the class of a territory space;
- means for testing the ability of a player to solve a problem;
- means option for assisting a player to solve a problem;
- tokens; and
- property pieces for placing on a territory space.

DETAILED DESCRIPTION OF THE INVENTION

The object of the game is to defeat the other players by bankrupting them. The game requires a player to exercise ability to solve a problem and judgement as between different levels of risk and potential reward associated with and without taking advantage of a means option for assisting the player to solve the problem.

An advantage of the game is that as one player is defeated by another, that first player may join the player that defeated them, and assist in solving problems. Thus there is no need for players to leave the game before it has been completed.

In the board game apparatus according to the invention, the board may be provided with a pictorial background, for example a map such as a map of the world, a continent, a country or a city. The territory spaces may each be marked with a name, for example a country, city or street, and may also carry a picture of something associated with that place. The territory spaces may also be grouped into sets, which sets may be provided by a common identifier, such as a colour. The sets may be further sub-divided into pairs. Each event space may be marked with some identifier which connects it with the means for determining an event affecting the standing of one or more players when a player piece lands on an event space.

The player pieces for moving from one space to another space in the loop may be, for example, figures, such as planes, rockets, cars, trains or people.

The means for determining which space a player piece is to be moved to may be, for example, a die. The die may be marked on a face with a symbol indicating that a player piece is not to be moved, such as a zero. In one embodiment, the die may be a sixteen sided die, two sides being marked with a zero and two of each of the other fourteen sides being marked with each of the numbers one to seven.

The means for determining an event affecting the standing of one or more players when a player piece lands on an event space may comprise, for example, a pack of cards, each of which recites an event. An event that has been found to add particular interest and excitement to the game is one in which a player is provided with an option, whereby when the player's player piece lands on a territory space controlled by another player and the player correctly solves the problem presented, the player may reduce the number of asset pieces on the territory space, may take control of that territory space, or may take control of the territory space and all of the asset pieces on it.

The means for determining a class of a territory space may be, for example, a pack of cards or a die, each card or face respectively of which recites a territory space class.

The means for marking the class of a territory space may be, for example, a dial depicting the alternative classes which maybe placed on a territory space. This may be a piece that can be inserted into a hole on the board.

The means for testing the ability of a player to solve a problem may comprise a pack of cards, each card of which recites a problem to be solved, such as a question or a task to be performed. For example it may be a knowledge question. Alternatively it may be a computer programmed to generate problems to be solved, for example questions to be answered or tasks to be performed. Such problems might conveniently be stored on a compact disc.

The means option for assisting a player to solve a problem may be, for example, a card carrying a clue or a graded series of clues to be taken at the option of the player. The card may be the same as that carrying the problem. Preferably the means option is graded in levels of difficulty according to the classes that may be applied to a territory space.

The tokens may represent money, and may be, for example coins or paper notes.

The asset pieces represent property, and may be, for example, figures of buildings or storeys of buildings that can be stacked to form skyscrapers.

The invention will now be described in more detail with reference to the accompanying drawing in which:

FIG. 1 shows game board (1) marked with a series of spaces arranged in a loop (2). The spaces consist of nine event spaces (3), marked "World News", twenty territory spaces (4), each marked with the name of a different city and with a "City Class Dial" (5), two spaces (6), marked "Global Government", and three spaces marked "Refuelling" (8). Optionally one or more "Refuelling" spaces may be replaced, for example by a "Free City Level" space. The board may be provided with a map of the world as a pictorial background. The territory spaces are grouped together in sets of four, each set being identified by a different colour. Each "City Class Dial" may show any of the classes U, A, B and C.

The game apparatus also consists of a sixteen sided die, two sides being marked with a zero and two of each of the other fourteen sides being marked with each of the numbers one to seven; player pieces in the form of jet aeroplanes; a pack of cards marked "World News"; a pack of cards marked "City Class" or a die; a pack of cards marked "Business Cards"; tokens representing coins worth different multiples of GLUTS, such as one GLUT (GLUT is short for GLobal Universal Token), Ten Gluts and One Hundred GLUTS; asset pieces consisting of "Base Pieces", "Skyscraper Levels" and "Penthouse Pieces"; and pieces marked "Exclusion Zone".

The "World News" cards describe events which may be beneficial or detrimental to any business consortium. The cards comprise five "World Disaster Cards". When a "World Disaster Card" is taken, a city identified on the card and all property on it is destroyed. An "Exclusion Zone" piece is placed over the space, and players do not land on the city space from then onwards. The cards also comprise "Extra Clue" cards, which may be kept and used when needed to obtain an extra clue to help answer a question on a Class A, Class B or Class C city. The cards further comprise "Reduce an Opponent's Hold" cards. These are kept and played when landing on an opponent's city before hearing any clues. If the player answers correctly, the player pays no fine to the opponent, and removes from one to four levels from the opponent's skyscraper, depending upon the instructions on the card. If this involves removing a foundation block on the city, then this is replaced with one of the player's foundation blocks: the player assumes control of the city. Another card is the "Massive Take-over Bid" card. When this card is played, the player must pay a charge to the opponent owning a city, then attempt to answer a question. If the question is answered correctly, the player wins control of the city and replaces all levels on it with its own pieces. Yet another card is a "Block Massive Take-over Bid" card, which can be played in response to a player using a "Massive Take-over Bid" card.

Other "World News" cards instruct a player to pay taxes to the government based upon the number of city spaces and numbers of levels on these held by the player; to pay or receive a fixed amount; to roll again; to move forwards or backwards a fixed or optional number of spaces; or to increase the class of a city space. It will be appreciated that the frequency with which players draw cards directing the payment or receipt of tokens, and the amounts to be paid or drawn should be selected so as to ensure an adequate supply of tokens into the game being played.

The game is set in the future. There is one global government with a single currency, known as the GLobal Universal Token, or GLUT. Each player or team represents a business consortium. In the game, the business consortiums compete for GLUTs, control of territory and property. The winner is the consortium that bankrupts all of its opponents. The game is played by the players moving their player pieces around the board, answering questions, taking decisions and receiving or paying out GLUTs.

The game is played by two or more, preferably from three to five players (which may be teams). At the start of the game each player receives a jet player piece and 100 GLUTS, made up, for example, of twenty times one GLUT and eight times ten GLUTS. The World News and City Class cards are shuffled and placed on the board, and the City Class Dials are set at U.

The teams each place their jets together on one of the "Global Government" spaces, and a representative from each team rolls the die. The team which rolls the highest number starts the game. The player then moves the jet clockwise around the loop of spaces by the number of spaces shown on the upper face of the die. If the die shows a zero, the player must roll again until a number is from one to seven is obtained. Thereafter, if the player throws a zero, the player's piece does not move that turn, and the player performs the action required of that space again.

If a player lands on a City space, the action taken depends upon whether or not it is controlled by an opponent and what class of city it is (U, A, B or C). If it is a U class city, no player has control of it. On arriving at a U class city, a player takes a City Class card (or rolls a die if a die is being used in place of cards). This card (or die) states the class (A, B or C) into which the city must be converted by the player in order to take control of it. Sometimes, a player will be given an option to choose between classes. A class A city is more difficult to take control of than a class B city, which in turn is more difficult to take control of than a class C city. An opponent then takes a Business Card", which provides a problem for the player to solve and reads out the problem.

For example, the Business Card may be headed with the topic "Famous People", then recite the following clues and answer:

Famous People

Clues:

1. A very famous UK rock singer who was born in 1940.
2. This singer's Christian (first) names are John Winston.
3. This singer was shot dead by a fan.
4. A founder member of The Beatles.
5. He wrote "Give Peace a Chance".

Answer: John Lennon.

Depending upon the class of city, the player may then receive one or more clues (provided on the card with the question): one clue for a class A, two clues for class B and three clues for class C. If the player answers correctly, it places one of its foundation blocks on the city space, indicating that it now has control of the city, and sets the dial to the appropriate city class (U, A, B or C). If the player answers incorrectly, then the player's turn ends.

If a player lands on a city space that is already a class A, B or C city, the next step depends on whether the city is controlled by the player or an opponent. If it is controlled by an opponent, the player must answer the question on the next business card, receiving the number of clues appropriate for that class of city. If the player answers incorrectly, a penalty must be paid to the opponent in accordance with the number of property levels the opponent has on that city. These are shown in Table 1 below.

TABLE 1

| Height of Skyscraper | Penalty (GLUTS) |
|---|---|
| Foundation Block Only | 15 |
| +1 level | 25 |
| +2 levels | 35 |
| +3 levels | 50 |
| +4 levels | 70 |
| Penthouse level | 100 |

If the opponent controls a pair of adjacent cities in a set, or a complete set of cities, an additional penalty must be paid. The additional penalty payable to an opponent where the opponent holds a pair of adjacent cities is 25 GLUTs, and for a complete set of cities, 50 GLUTs. However, if the player answers correctly, no penalty is paid and the player's turn ends.

If the player holds the city, the player may still answer a question on a business card. If the answer given is correct, the player receives another level to add to the player's skyscraper.

When a player's piece lands on a "Free City Level" space, the player may place one skyscraper level on a City space in the player's control. The player's turn then ends.

When a player's piece lands on a "Refuelling" space, the player's turn simply ends.

During a player's turn, the player may also barter with other players, buying from them or selling to them control of City spaces with all of the skyscraper levels. When control of a city changes, the player now controlling it replaces the skyscraper level pieces with pieces in their own colour.

Players may raise GLUTs during their turn by selling skyscraper levels and control of City spaces back to the government. The amounts paid by the government are, for example, set out in Table 2.

TABLE 2

| Class | Foundation Block | Per Level |
|---|---|---|
| A | 25 | 10 |
| B | 18 | 7 |
| C | 10 | 3 |

If a foundation block is sold to the government, the player loses control of the city space, and the dial is reset to U.

When a player's piece lands on a "Global Government" space, the player receives an opportunity to obtain one or more skyscraper levels for his cities by taking a "Business Card" and trying to solve the problem on it.

It will be appreciated that the rules of the game may be varied without departing form the general structure of the game. For example, additional clues may be provided to selected players where an imbalance in the general knowledge would spoil the game. The game may also be shortened by providing players from the start with control of selected cites.

According to another aspect, the present invention provides a computer game apparatus, comprising a computer programmed to simulate the board game apparatus as defined hereinabove, a screen and means for effecting a player's move.

The means for effecting a player's move may be, for example, a keyboard, a mouse or a joystick.

I claim:

1. A method of playing a board game, which comprises providing players with a board game apparatus comprising:

a board marked with a series of spaces arranged in a loop, said spaces comprising an event space and territory spaces;

player pieces for moving from one space to another space in the loop;

means for determining which space a player piece is to be moved to;

means for determining an event affecting the standing of one or more players when a player piece lands on an event space; and means for determining outcomes when player pieces land on territory spaces, said means comprising means for determining a class of a territory space;

means for marking the class of a territory space;

means for testing the ability of a player to solve a problem;

means option for assisting a player to solve a problem;

tokens; and property pieces for placing on a territory space;

said method comprising placing player pieces on the game board, determining the number of spaces by which a player piece is to be moved using the means for determining which space a player piece is to be moved to, and following the directions given consequent to the player piece arriving at that space, and when a player is defeated, that player joins the player that defeated them and assists in solving problems.

2. A method as claimed in claim 1, in which the territory spaces are grouped into sets.

3. A method as claimed in claim 1, in which the means for determining which space a player piece is to be moved to comprises a die.

4. A method as claimed in claim 3, in which one side of the die is marked with a symbol indicating that a player piece is not to be moved.

5. A method as claimed in claim 1, in which the means for determining an event affecting the standing of a player when a player lands on an event space comprises a pack of cards, each of which recites an event.

6. A method as claimed in claim 5, in which the event is one in which a player is provided with an option, whereby when the player's player piece lands on a territory space controlled by another player and the player correctly solves the problem presented, the player may reduce the number of asset pieces on the territory space, may take control of that territory space, or may take control of the territory space and all of the asset pieces on it.

7. A method as claimed in claim 1, in which the means for determining a class of a territory space comprises a pack of cards, each of which recites a class which may be applied to a territory space.

8. A method as claimed in claim 1, in which the means for testing the ability of a player to solve a problem comprises a pack of cards, each of which recites a problem to be solved.

9. A method as claimed in claim 8, in which a problem to be solved is a knowledge question.

10. A method as claimed in claim 1, in which the means option for assisting a player to solve a problem comprises a card carrying a clue or a graded series of clues.

11. A method as claimed in claim 1, in which a means option for assisting a player to solve a problem is graded in levels of difficulty according to the classes that may be applied to a territory space.

12. A method as claimed in claim 1, in which the means for marking the class of a territory space is a dial depicting the alternative classes which may be placed on a territory space.

* * * * *